US008905732B2

(12) United States Patent
Kuttler et al.

(10) Patent No.: US 8,905,732 B2
(45) Date of Patent: Dec. 9, 2014

(54) FLUID WORKING MACHINE

(75) Inventors: Onno Kuttler, Dalkeith (GB); Uwe Stein, Edinburgh (GB)

(73) Assignee: Danfoss Power Solutions APS, Nordborg (DK)

( * ) Notice: Subject to any disclaimer, the term of this patent is extended or adjusted under 35 U.S.C. 154(b) by 408 days.

(21) Appl. No.: 12/740,778

(22) PCT Filed: Oct. 29, 2008

(86) PCT No.: PCT/DK2008/000382

§ 371 (c)(1),
(2), (4) Date: Oct. 14, 2010

(87) PCT Pub. No.: WO2009/056138

PCT Pub. Date: May 7, 2009

(65) Prior Publication Data

US 2011/0020159 A1 Jan. 27, 2011

(30) Foreign Application Priority Data

Nov. 1, 2007 (EP) ..... 07254338

(51) Int. Cl.

| | |
|---|---|
| ***F04B 7/00*** | (2006.01) |
| ***F04B 49/06*** | (2006.01) |
| ***F04B 49/03*** | (2006.01) |
| ***F04B 53/22*** | (2006.01) |
| ***F04B 53/10*** | (2006.01) |

(52) U.S. Cl.

CPC ..... *F04B 53/22* (2013.01); *F04B 7/0076* (2013.01); *F04B 53/1082* (2013.01)

USPC ..... 417/505; 417/454; 417/559

(58) Field of Classification Search

USPC ..... 417/415, 454, 471, 505, 559, 568; 137/512, 614.2; 60/375, 486, 493

See application file for complete search history.

(56) References Cited

U.S. PATENT DOCUMENTS

| | | | | |
|---|---|---|---|---|
| 1,507,448 | A * | 9/1924 | Aldrich | 137/512 |
| 3,319,419 | A | 5/1967 | Hann | |
| 3,962,870 | A | 6/1976 | Lech | |
| 3,985,472 | A | 10/1976 | Virtue et al. | |

(Continued)

FOREIGN PATENT DOCUMENTS

| | | | |
|---|---|---|---|
| DE | 4306377 | A1 | 9/1994 |
| EP | 0361927 | A1 | 4/1990 |

(Continued)

OTHER PUBLICATIONS

International Search Report dated Feb. 2, 2009 from Serial No. PCT/DK2008/000382.

(Continued)

*Primary Examiner* — Bryan Lettman

(74) *Attorney, Agent, or Firm* — McCormick, Paulding & Huber LLP

(57) ABSTRACT

In usual hydraulic pumps, a separate assembly opening is provided for every valve of the hydraulic pump. This design causes sealing problems. It is proposed, that the fluid inlet valve and the fluid outlet valve can be assembled through a common assembly access port. Further, the fluid inlet valve and the fluid outlet valve can be arranged around a common cavity, or even within the same cavity, via the common assembly access port in the fluid working machine's body.

13 Claims, 13 Drawing Sheets

(56) References Cited

U.S. PATENT DOCUMENTS

| | | | | |
|---|---|---|---|---|
| 4,321,014 | A | 3/1982 | Eburn, Jr. et al. | |
| 4,382,485 | A | 5/1983 | Kirkham | |
| 4,813,234 | A | 3/1989 | Nikolaus | |
| 4,815,946 | A | 3/1989 | Cusack | |
| 5,046,926 | A | 9/1991 | Deininger et al. | |
| 5,165,862 | A | 11/1992 | Lindblom | |
| 5,176,504 | A | 1/1993 | Moriya et al. | |
| 5,186,612 | A | 2/1993 | Budzich | |
| 5,190,446 | A | 3/1993 | Salter et al. | |
| 5,259,738 | A * | 11/1993 | Salter et al. | 417/505 |
| 5,354,180 | A | 10/1994 | Forster | |
| 5,527,156 | A | 6/1996 | Song | |
| 5,636,975 | A * | 6/1997 | Tiffany et al. | 417/454 |
| 5,700,136 | A | 12/1997 | Sturman | |
| 5,921,759 | A | 7/1999 | Khan | |
| 6,029,445 | A | 2/2000 | Lech | |
| 6,055,851 | A | 5/2000 | Tanaka et al. | |
| 6,126,418 | A | 10/2000 | Sinnl | |
| 6,183,207 | B1 | 2/2001 | Sturman | |
| 6,283,724 | B1 | 9/2001 | Alaze et al. | |
| 6,681,571 | B2 | 1/2004 | Bailey et al. | |
| 6,682,316 | B1 * | 1/2004 | Boke | 417/307 |
| 2002/0001526 | A1 | 1/2002 | Howard | |
| 2004/0055580 | A1 * | 3/2004 | Yamada et al. | 123/495 |
| 2004/0091365 | A1 * | 5/2004 | Spiegl et al. | 417/53 |
| 2004/0105763 | A1 | 6/2004 | Kondo | |
| 2005/0229975 | A1 * | 10/2005 | Moe et al. | 137/454.4 |
| 2006/0039795 | A1 | 2/2006 | Stein et al. | |
| 2006/0239846 | A1 * | 10/2006 | Oda et al. | 417/505 |
| 2008/0019853 | A1 * | 1/2008 | Hashida et al. | 417/490 |
| 2008/0141670 | A1 | 6/2008 | Smith | |
| 2008/0245323 | A1 | 10/2008 | Williamson et al. | |
| 2009/0113888 | A1 | 5/2009 | Kuttler et al. | |
| 2009/0120086 | A1 | 5/2009 | Kuttler et al. | |

FOREIGN PATENT DOCUMENTS

| | | | |
|---|---|---|---|
| EP | 494236 | | 7/1992 |
| EP | 0577783 | | 1/1994 |
| EP | 1319836 | A2 | 6/2003 |
| EP | 1469237 | A1 | 10/2004 |
| EP | 1537333 | | 6/2005 |
| EP | 2055943 | A1 | 6/2009 |
| EP | 2055944 | A1 | 6/2009 |
| EP | 2055945 | A1 | 6/2009 |
| EP | 2055946 | A1 | 6/2009 |
| GB | 968452 | A | 9/1964 |
| GB | 1374752 | A | 11/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000385.

International Search Report dated Feb. 2, 2009 from Serial No. PCT/DK2008/000381.

International Search Report dated Feb. 2, 2009 from Serial No. PCT/DK2008/000386.

International Search Report dated Feb. 2, 2009 from Serial No. PCT/DK2008/000384.

* cited by examiner

FLUID WORKING MACHINE

CROSS REFERENCE TO RELATED APPLICATIONS

This application is entitled to the benefit of and incorporates by reference essential subject matter disclosed in International Patent Application No. PCT/DK2008/000382 filed on Oct. 29, 2008 and EP Patent Application No. 07254338.2 filed Nov. 1, 2007.

FIELD OF THE INVENTION

The invention relates to a fluid working machine, comprising at least one working chamber of cyclically changing volume, at least one fluid inlet port with a fluid inlet valve and at least one fluid outlet port with a fluid outlet valve. Further, the invention relates to a valve assembly comprising at least one fluid inlet port with a fluid inlet valve and at least one fluid outlet port with a fluid outlet valve.

BACKGROUND OF THE INVENTION

Such fluid working machines are generally used, when fluids are to be pumped. Such pumping of fluids can relate to both gases and liquids. Of course, the word fluid can even relate to a mixture of gas and liquid and furthermore to a supercritical fluid, where no distinction between gas and liquid can be made anymore.

In particular, such fluid working machines are used, if the pressure level of a fluid has to be increased. For instance, such a fluid working machine could be an air compressor or a hydraulic pump. Fluid working machines generally comprise one or more working chambers of a cyclically changing volume. For each cyclically changing volume, there is provided a fluid inlet valve and a fluid outlet valve. When the volume of the working chamber increases, the fluid inlet valve opens, while the fluid outlet valve closes. Therefore, fluid at the low pressure level is sucked into the working chamber. As soon as the volume of the working chamber has reached its maximum and starts to decrease, the fluid inlet valve closes. When the fluid pressure within the working chamber has reached the pressure level of the high pressure level, the fluid outlet valve opens and fluid is ejected to the high pressure side at the high pressure level. When finally the working chamber has reached its minimal volume, the fluid outlet valve closes, the volume of the working chamber starts to increase again and the fluid inlet valve opens. Therefore, the pumping cycle starts again.

Traditionally, the fluid inlet and fluid outlet valves are passive valves. I.e., the valves open themselves under the influence of a pressure difference on both sides of the valve. Of course, the valves open in only one direction, whereas in the closing direction of the valves, the valves are closed, independent of the magnitude of pressure difference. A typical design of such a valve is a check valve or a poppet valve.

Lately, there were proposed synthetically commutated hydraulic pumps, where the opening and closing of the inlet valves and/or the outlet valves is controlled by a controlling unit of the synthetically commutated hydraulic pump. Those synthetically commutated hydraulic pumps are also known as digital displacement pumps or variable displacement pumps.

The advantage of such a controlled opening and closing of the inlet and/or outlet valves is, that several modes of operation of the hydraulic pump can be achieved. If the inlet and outlet valves are controlled in a way, analogously to the traditional passive opening and closing of the valves, a full stroke pumping mode is achieved.

However, by appropriate control of the opening/closing state of the valves, different modes can be achieved. For instance, if the inlet valve is held open during the whole working cycle of the pump, a non-pumping mode can be achieved. In this mode, the fluid is sucked from the low pressure fluid reservoir and pushed back into the low pressure fluid reservoir, during a full cycle of the working chamber. However, no effective pumping to the high pressure side of the pump is performed.

Another mode can be reached, if the fluid inlet valve is held open during part of the volume decreasing stroke of the working chamber. If the fluid inlet valve is closed after the working chamber has reduced to e.g. half of its size, only half of the available pumping volume is used for pumping. The pumping flow rate is therefore at approximately 50% of the maximum. Therefore, a partial stroke pumping mode can be achieved.

Said three pumping modes can be realised, even if only the fluid inlet valve is actively controlled, and the fluid outlet valve is still of a passive type.

However, even more modes of operation can be achieved, if the fluid outlet valve can be actively controlled as well:

The fluid outlet valve is held open during the phase, where the volume of the fluid working chamber increases, while the fluid inlet valve is held closed at the same time. The state of the fluid inlet valve and the state of the fluid outlet valve are interchanged, when the volume of the working chamber decreases. This way, fluid can be transferred in the reverse direction, i.e., fluid is transferred from the higher pressure level to the lower pressure level. The energy stored by the elevated pressure level of the hydraulic fluid can be used to drive the fluid working machine. Therefore, the synthetically commutated hydraulic pump is used in a motoring mode.

By controlling the opening/closing state of the inlet valve and the outlet valve, in the sense of the partial stroke pumping mode, a partial stroke reverse pumping mode a partial stroke motoring mode can be achieved as well.

Independent of the actual design of the valves as actively controllable valves or as passive valves, the inlet valves and the outlet valves are usually placed in a fluid inlet channel and a fluid outlet channel, provided in the fluid working machine, respectively. The fluid inlet channel connects the low pressure fluid reservoir with the working chamber of the fluid working machine, whereas the fluid outlet channel connects the working chamber of the fluid working machine with the high pressure side of the system. According to the state of the art, the fluid inlet valves and the fluid outlet valves are connected to the fluid working machine through separate access ports. For example, two fluid channels are provided in the cylinder head portion of a fluid working machine. A fluid inlet valve unit is assembled to the fluid working machine's body by inserting it from the outside into the fluid inlet channel. Likewise, the fluid outlet valve is assembled to the fluid working machine by inserting it from the outside into the fluid outlet channel. Therefore, two access ports for mounting the two valves are used.

Such a design, where each cylinder of the fluid working machine needs at least two separate access ports causes problems. The access ports and the corresponding cavities have to be machined into the pump body. Therefore, a high number of machining processes has to be performed. If the pump body is molded, a relatively complex molding process has to be performed. Furthermore, the machining of the raw parts is relatively complex.

Additionally, because of the increased number of components, which have to be installed in the pump body, the number of assembly steps is high. Furthermore, the amount of sealing points is relatively high, as well. The latter one increases the possibility of fluid leakage as well.

Both U.S. Pat. No. 5,190,446 and US 2006-0039795 A1 show examples of synthetically commutated hydraulic pumps, according to the state of the art. The fluid inlet valves and the fluid outlet valves of the working chambers of cyclically changing volume connect to said working chambers through separate access ports. In the embodiments shown, the direction of the fluid inlet valve is arranged perpendicular to the direction of the fluid outlet valve. The valves are assembled to the pump bodies through separate assembly ports and are installed in separate cavities.

SUMMARY OF THE INVENTION

Therefore, the object of the invention is to provide a fluid working machine with a simplified design.

To solve the problem, a fluid working machine of the aforementioned kind is proposed, wherein said fluid inlet valve and said fluid outlet valve can be assembled through a common assembly access port. In other words, when assembling the fluid working machine, the fluid inlet valve and the fluid outlet valve can be arranged around a common cavity (or even within the same cavity) via a single opening (access port) in the fluid working machine's body.

If the fluid working machine has more than one working chamber, the above mentioned design should be true for at least one working chamber, preferably for all working chambers. With the proposed design, it is possible to decrease the number of areas where a sealing has to be provided. Depending on the actual design, it might also be possible to decrease the pressure differences, occurring at least part of the sealings. Therefore, the possibility of leaks can be reduced. So far, the proposed design has not been realised in the state of the art. This is perhaps due to the fact, that hydraulic pumps and combustion engines are technically related to each other up to a certain extent. The proposed design will usually lead to a certain volume, where both low pressure fluid, being sucked into the working chamber, and high pressure fluid, being expelled from the working chamber, are passing through. When it comes to combustion engines, however, it is absolutely essential, not to mix up the fresh carburated air and the exhaust fumes. However, the inventors have surprisingly discovered that this "mixing" has no or only a negligible effect in the present field of hydraulic pumps. It has to be noted, that the notion "fluid working machine" can stand for a hydraulic pump, a hydraulic motor and a combination of both. For the assembly, threaded connections can be used.

Although, in principle, the fluid inlet valve and the fluid outlet valve can have the same cross section for the fluid passing by, it is preferred, that the fluid inlet valve has a larger cross section than the fluid outlet valve. Using this design, the efficiency of the fluid working machine can be increased. This is, because on the fluid inlet side, the absolute pressures are much lower than on the fluid output side. A fluid valve is, even in its open state, an obstacle for the fluid passing by. Therefore, the valve will cause a certain pressure drop in the fluid, passing by, for example a pressure drop of 0.2 bar. Such a pressure drop of 0.2 bar will, however, translate to a certain relative pressure drop, when expressed as a ratio of absolute pressure drop and ambient pressure. Therefore, due to the different pressure drop, the relative pressure drop will be much higher on the fluid inlet side, than on the fluid outlet side. Therefore, to improve effectiveness, the fluid inlet cross section should be made as large as possible. However, the fluid outlet valves can be built smaller, without loosing efficiency significantly. However, by building the fluid outlet valve smaller, costs can be reduced.

Preferably, the fluid inlet and the fluid outlet valve are arranged around a common pre-chamber which is fluidly connected to the working chamber. Such a pre-chamber can provide a (shared) receiving space for the valve heads in their open position. Accordingly, the space needed can be reduced. Furthermore, the common pre-chamber can be used for smoothing pressure pulses. Therefore, noise can be reduced and small deviations in the timing of the opening/closing of the valves, relative to the optimum, can be compensated.

It is possible, that the fluid inlet valve and the fluid outlet valve are arranged as separate units. Using this design, it is possible, that standard valves can be used for at least some of the necessary valves. Furthermore, a wider range of combinations of inlet and outlet valves can be achieved, without increasing the variety of valve assemblies (valve combinations) to be stored. It is also possible, that one inlet valve is combined with two separate fluid outlet valves.

Preferably, the said fluid inlet valve and the said fluid outlet valve are arranged as a separate subassembly. When using such a design, the valve part of the fluid working machine can be assembled and stored as a separate valve sub-unit and finally be connected to the cylinder block. This can enhance productivity.

For instance, the valve block and the cylinder part of the fluid working machine can be produced at different times and/or locations as separate subunits. Finally, both subassemblies are connected to each other in a single processing step. Also, pre-assembled valve units of a certain type can be used for different fluid working machines, at least up to a certain extend. For instance, a certain type of a valve unit can be used for fluid working machines with a different number of working spaces or fluid working machines with a different volume of each working chamber.

Additionally, the connection can be releasable, for interchanging parts. For instance, a valve sub-assembly can comprise a threaded male connecting section, which can be simply screwed into a threaded female connecting section in the cylinder block. It should be noted, that even with a combined subassembly, comprising a fluid inlet valve and a fluid outlet valve, it is still possible to combine this subassembly with additional fluid inlet and/or fluid outlet valves, in particular with additional fluid outlet valves.

Furthermore, it is possible that the fluid inlet valve and/or the fluid outlet valve and/or the valve subassembly comprise(s) integrated sealing means for sealingly closing the common assembly access port. Using such design, productivity can be even further enhanced. Because the sealing means can form an integral part of the respective unit, a leakage-proof sealing can be provided by simply assembling the respective part. Therefore, separate assembly steps can be avoided.

Preferably, that working chamber comprises a reciprocating piston in a cylinder. By such a design, the changing volume can be made very large, so that the fraction of total volume to dead volume can be increased. Therefore, the shrinkage of the fluid working machine at higher pressures can be decreased. This can increase the efficiency and effectiveness of the fluid working machine.

In case the fluid working machine comprises a plurality of working chambers, fluid inlet ports and/or fluid outlet ports, it is preferred that said plurality of fluid inlet ports connect to a common fluid inlet manifold and/or said plurality of fluid outlet ports connect to a common fluid outlet manifold, respectively. By such a design, the number of external connections can be decreased. Particularly, it is possible that only two external connections, i.e. a single fluid inlet connection and a single fluid outlet connection, are to be provided. By such a design, assembly work can be decreased. Furthermore, it is possible to minimise fluid leaks.

Preferably, at least part of said fluid inlet valves and/or at least part of said fluid outlet valves are actively controllable. Particularly, they can be electrically controlled. By such a design, not only a full stroke pumping mode can be realised, but also a non-pumping mode, a partial stroke pumping mode and presumably a full stroke reverse pumping mode and/or a partial stroke reverse pumping mode can be realised. Therefore, the usability and flexibility of the fluid working machine can be increased even further.

A preferred design is obtained, if one outlet valve comprises a plurality of circumferentially arranged holes and/or an essentially circumferential opening, and at least one corresponding closing means, associated to said opening(s), wherein the closing force of the closing means is exerted by an elastic member. Using this design, the total cross section of the fluid outlet valve (and consequently even the cross section of the fluid inlet valve) can be increased. Thus, fluid losses can be minimised. Furthermore, this design is relatively simple and therefore can be produced cheaply. The elastic member can be a common elastic member for all (or at least several) closing means. Also it is possible, that each closing means (or part of them) has an individual elastic member, e.g. a spring for each ball. The elastic member can comprise an elastic band or can comprise (metal) springs.

Yet another possible design is obtained, if at least one outlet valve comprises a plurality of circumferentially arranged holes and/or an essentially circumferential opening, and at least one closing means, corresponding to said opening(s), wherein said closing means comprises at least one actuator, preferably at least one coil. The closing means can be actuated directly or indirectly by the actuator. If a coil is used as an actuator, the coil can provide a magnetic field, which is able to open the closing means of the outlet valve (directly or indirectly). The coil and the magnetic part, interacting with a magnetic field, produced by the coil, should be dimensioned in a way, that the magnetic field is sufficient to counteract the closing force of the closing member. This closing force can be provided, e.g. by one or several closing springs.

According to a second aspect of the invention, the problem can be solved by using a valve assembly of the aforementioned type, that comprises a common connection port for fluidly connecting said valve assembly to a working chamber of cyclically changing volume of a fluid working machine.

Said valve assembly can preferably be combined with at least one of the already mentioned features, given in reference to the proposed fluid working machine.

With such a proposed valve assembly, the already mentioned objects and advantages can be obtained analoguously.

BRIEF DESCRIPTION OF THE DRAWINGS

The present invention and its advantages will become more apparent, when looking at the following description of preferred embodiments of the invention, which will be described with reference to the accompanying figures, which are showing.

DETAILED DESCRIPTION OF THE PREFERRED EMBODIMENTS

Figure 1:
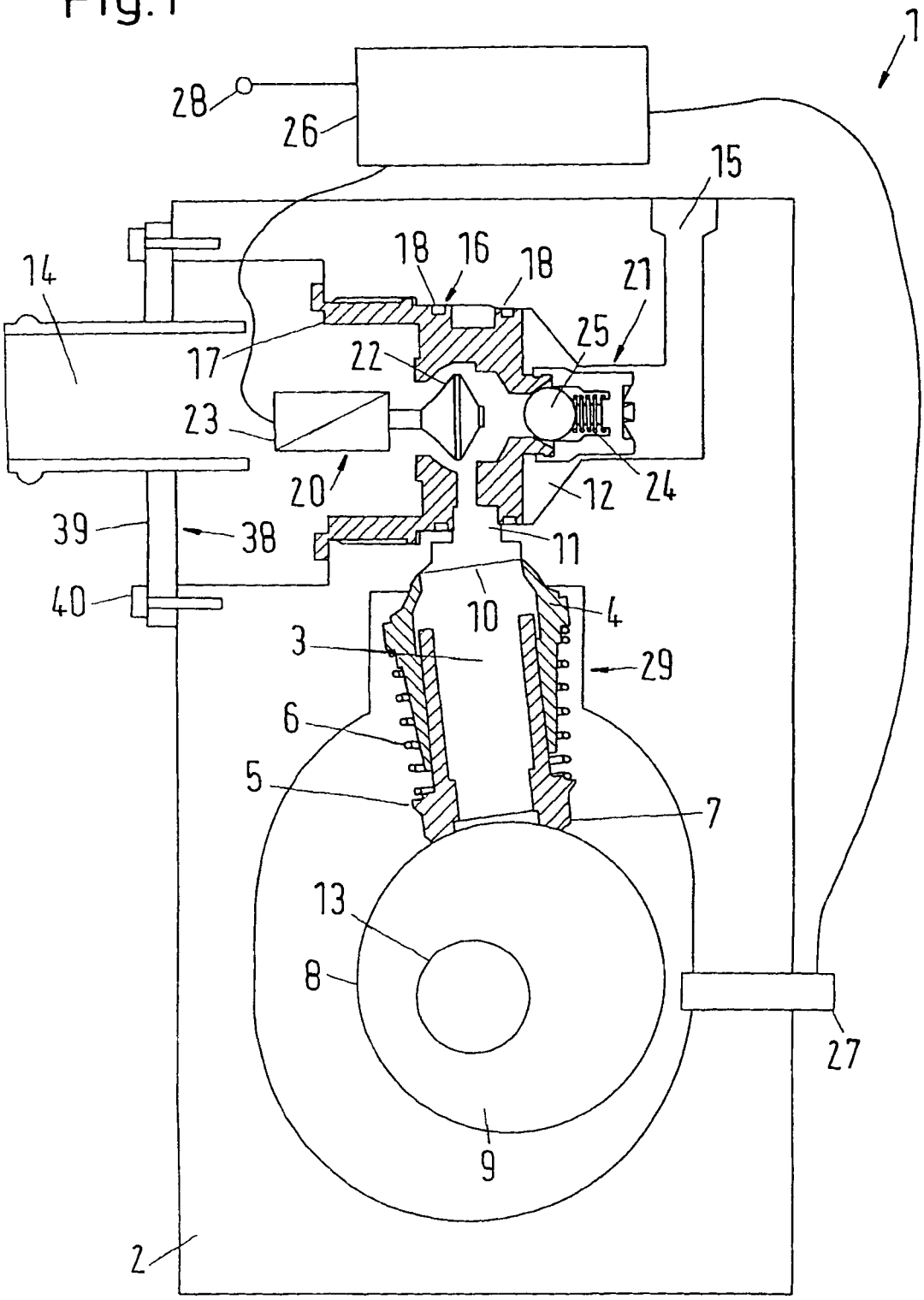
FIG. 1 is a schematic cross section of a first example on a hydraulic pump according to the invention.

In FIG. 1 a synthetically commutated hydraulic pump 1, which is constructed according to an embodiment of the invention, is shown. The hydraulic pump 1 comprises a pump body 2, in which the various parts are arranged. The hydraulic pump 1 has a working chamber 3, which has a cyclically changing volume, when the hydraulic pump 1 is in use. The working chamber 3 is essentially formed by a piston assembly 29, comprising a cylinder 4 and a piston 5. A spring 6 contacts both the piston 5 and the cylinder 4 in a way, that the piston 5 and the cylinder 4 are pushed away from each other by the force of the spring 6. The piston pad 7 of the piston 5 contacts the surface 8 of a cam 9, which is attached to a rotatable shaft 13. The rotatable shaft 13 can be driven by any kind of a mechanical power source, for example by a combustion engine, an electric motor, a transmission, a turbine or any other appropriate rotational power source.

When the rotatable shaft 13 is turning, the eccentric shape of the cam 9 surface 8 and the force exerted by the spring 6 cause the piston 5 and the cylinder 4 to cyclically move closer together and further apart. This movement of cylinder 4 and piston 5 relative to each other causes a cyclically changing volume of the working chamber 3.

On top of the cylinder 4, there is provided an opening 10, which is connected to a fluid channel 11. In the depicted embodiment, the fluid channel's 11 cross section is reduced, as compared to the cross section of the top opening 10 in the cylinder 4 and the cross section of the working chamber 3 itself.

Adjacent to the fluid channel 11, a single cavity 12 is formed within the cylinder block 2. The single cavity 12 serves as a common installation access cavity, which will be explained in detail later on. A fluid inlet port 14 and a fluid outlet port 15 is further provided. The fluid inlet port 14 connects the single cavity 12 to a low pressure fluid reservoir. The fluid outlet channel 15 connects the single cavity 12 to the high pressure side with further hydraulic components (not shown) which are to be driven by the hydraulic pump 1.

Inside the single cavity 12, an integral valve assembly 16 is provided. The integral valve assembly 16 comprises a valve body 17, a fluid inlet valve 20 and a fluid outlet valve 21.

In the valve body 17, two sealing rings 18 are provided to fluidly seal the fluid inlet port 14, the working chamber 3 and the fluid outlet port 15 from each other, respectively.

In the embodiment shown in FIG. 1, the fluid inlet valve 20 is formed as an actively controllable valve, comprising a valve poppet 22 and a valve actuator 23 associated with the valve poppet 22. The fluid outlet valve 21 is of a passive type. The fluid outlet valve 21 is formed as a spring-loaded 24 ball-type 25 check valve.

The valve actuator unit 23 is actively controlled by an electronic controlling unit 26. Furthermore, sensor means 27, sensing a signal representative of the cam's 9 position, are provided and connected to the controlling unit 26 as well. Depending on the cam's 9 position, which is indicative of the hydraulic power unit's 1 working phase, the controlling unit 26 switches the fluid inlet valve 20 in an open and closed position, appropriately. The behaviour of the controlling unit 26 can be influenced by an input signal 28, by which the controlling unit can be switched to a full stroke pumping mode, a non-pumping mode, a partial stroke pumping mode or the like, as it is known in the state of the art. The input signal 28 can depend on an external flow set point. Furthermore, the speed of the hydraulic pump 1 can be derived from the sensor 27 output.

It can be clearly seen from FIG. 1 that the integral valve assembly 16 is formed as a separate sub-assembly. It is possible to manufacture the integral valve assembly 16 as a separate unit. The integral valve assembly 16 can be mounted by appropriate attachment means, into the single cavity 12, provided within the pump body 2 of the hydraulic pump 1. As attachment means, screws, bolts, a thread or the like can be used.

The integral valve assembly 16 can be installed in the pump body 2, namely inside the single cavity 12, through a single, common assembly access port 38. Therefore, it is not necessary to install separate valves from the outside of the pump body 2 through several assembly ports, as it is done in the state of the art. The assembly access port 38 can be closed by a plate 39, wherein in the example shown, plate 39 is integrally formed with fluid inlet port 14. Plate 39 can be attached to the pump body 2 by appropriate attachment means, e.g. by screws 40. A sealing ring (not shown) can be provided between the plate 39 and the pump body 2.

By providing an integral valve assembly 16 as a sub-assembly, a certain type of integral valve assembly 16 can be used for different types of hydraulic pumps 1, which differ, for example, in the working chamber's 3 volume, the number of pistons 5, or the like.

Furthermore, maintenance of the hydraulic pump 1 can be simplified and speeded up. In case a valve needs to be replaced, the whole integral valve assembly 16 can be replaced by another integral valve assembly 16. The replaced integral valve assembly 16 can be serviced and adjusted in a machine shop later.

Figure 2:
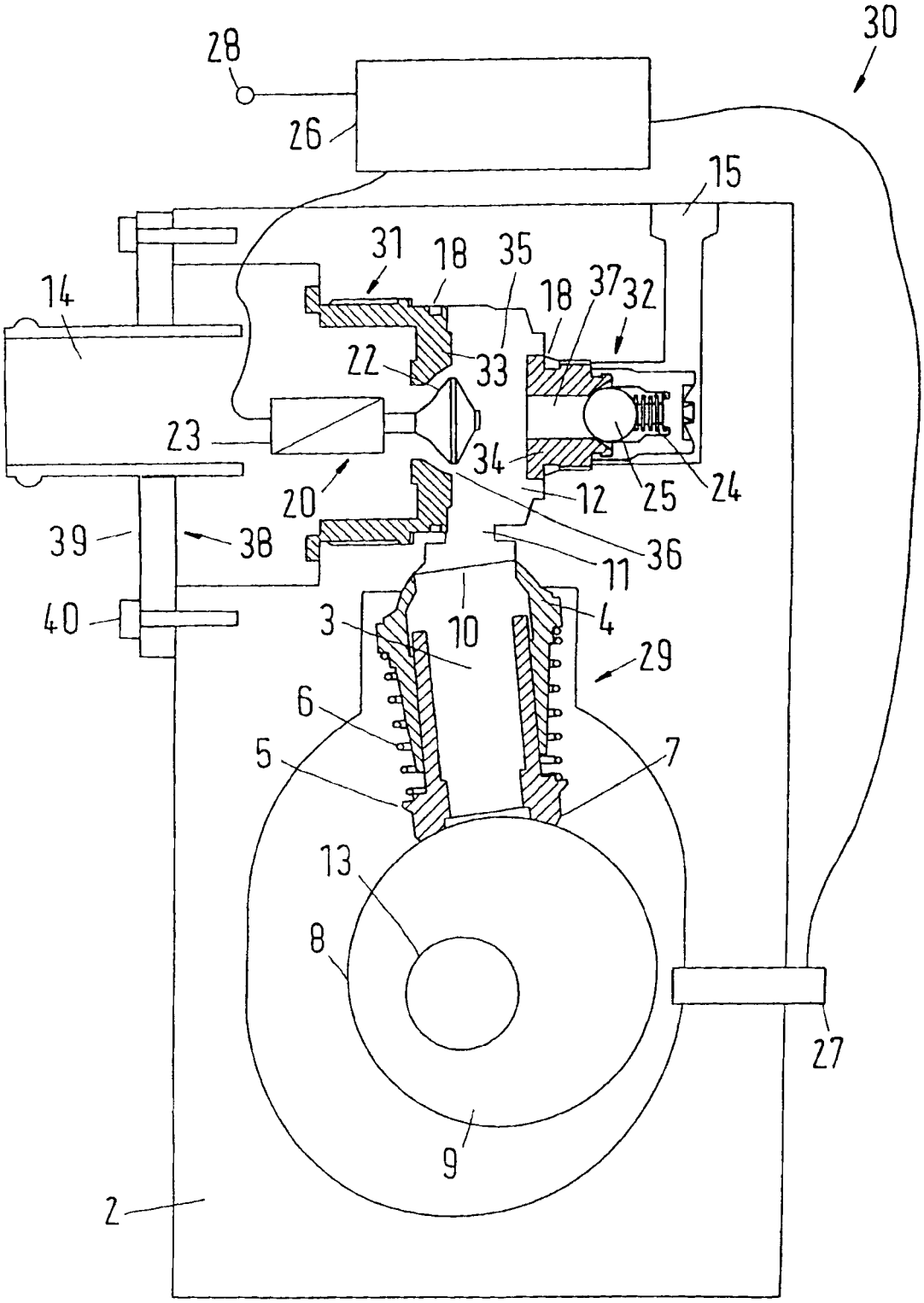
FIG. 2 is a schematic cross section of a second example of a hydraulic pump according to the invention.

In FIG. 2 another example of a hydraulic pump 30 according to the invention is shown.

The hydraulic pump 30 of the second type and the hydraulic pump 1 of the type, shown in FIG. 1, have several features in common. Therefore, similar parts are numbered with the same numbers for clarity reasons.

Similar to the hydraulic pump 1 shown in FIG. 1, the present hydraulic pump 30 comprises a piston assembly 29, having a piston 5, a cylinder 4 and a spring 6. The piston 5 reciprocates in and out of the cylinder 4 under the influence of the cam 9 and the force, exerted by the spring 6. This reciprocating movement changes the volume of the working chamber 3 cyclically, thus providing a pumping action for the hydraulic fluid.

Inside the pump body 2, a single cavity 12 is formed, which can be of the same shape as the single cavity 12 within the hydraulic pump 1, shown in FIG. 1.

In the present embodiment, however, two separate valve assemblies are provided, namely an inlet valve assembly 31 and an outlet valve assembly 32.

The inlet valve assembly 31 comprises a first attachment structure 33, to which an actively controllable fluid inlet valve 20, having a valve poppet 22 and a valve actuator unit 23, is attached. The second attachment structure 34 holds a spring 24 loaded ball-shaped check valve 25.

In both attachment structures 33, 34, a groove is provided, into which a sealing ring 18 is inserted, respectively.

The hydraulic pump 30 shown in FIG. 2 is very flexible in use, because both inlet valve 20 and outlet valve 32 can be exchanged and mounted independently of each other. So more varieties of different types of hydraulic compressors 30 can be achieved.

As can be seen from FIG. 2, the fluid channel 11 connects the pre-chamber 35 and the working chamber 3 with each other. The valve channel 36 of the fluid inlet valve 20 and the valve channel 37 of the fluid outlet valve 32 both connect to the pre-chamber 35 as well. Of course, a fluid connection between fluid inlet channel 14 and pre-chamber 35 and between pre-chamber 35 and fluid outlet channel 15 exists only, if the respective valve 20, 32 is in its open position.

Although in the hydraulic pump 30 of FIG. 2, the fluid inlet valve 20 and the fluid outlet valve 32 are forming two units, which are separate from each other, both inlet valve 20 and outlet valve 32 can be inserted into the single cavity 12 through the common, single assembly access port 38. This feature is very similar to the hydraulic pump 1 of FIG. 1. In the same way, the single assembly access port 38 is closed by a plate 39. The closing plate 39 is integrally formed with a fluid inlet port 14. A sealing ring can be provided, as well.

Figure 3:
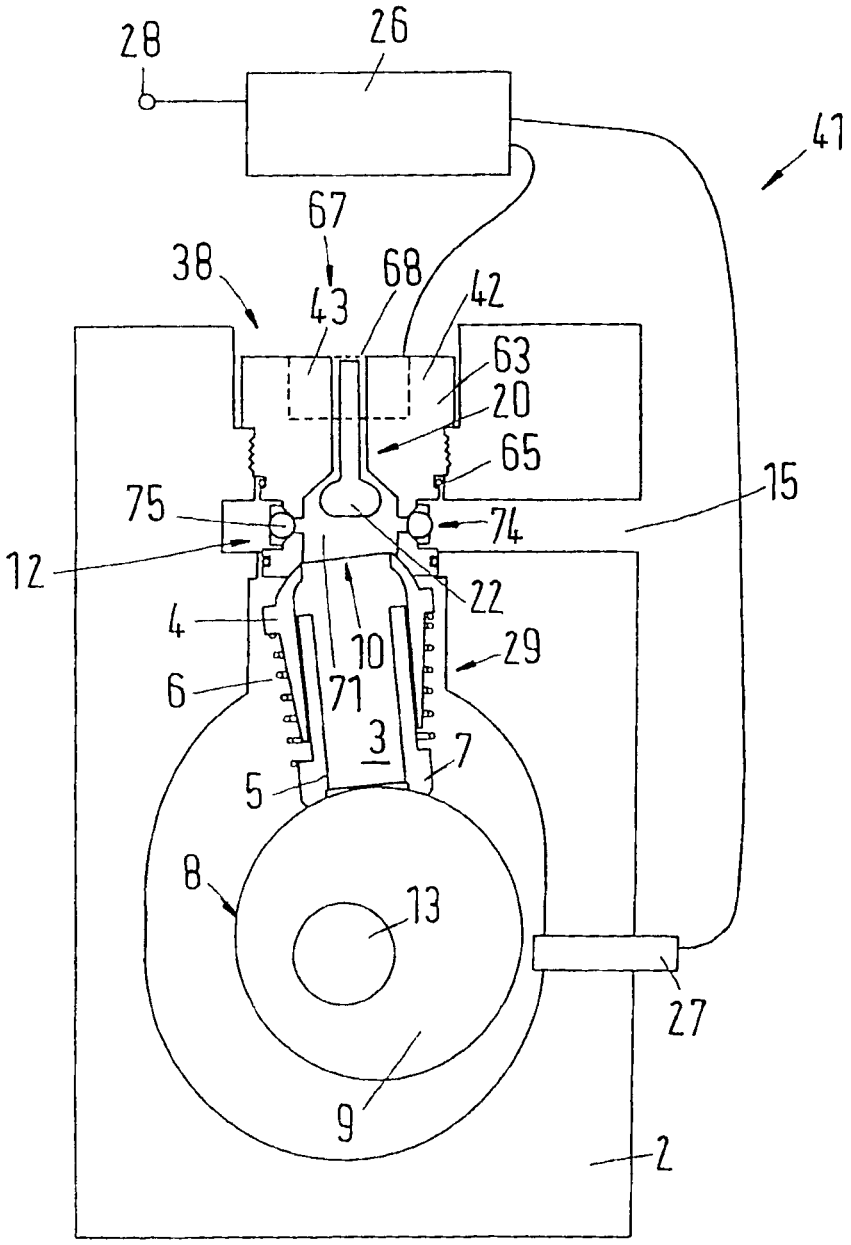
FIG. 3 is a schematic cross section of a third example of a hydraulic pump according to the invention.

In FIG. 3, another example of a hydraulic pump 41 is shown. To a certain extent, the hydraulic pump 41 of FIG. 3 is similar to the hydraulic pump 1, shown in FIG. 1. Also, the same reference numbers are used for similar parts. Also, no detailed description of the pumping section of the hydraulic pump 41 is given for brevity.

Figure 4:
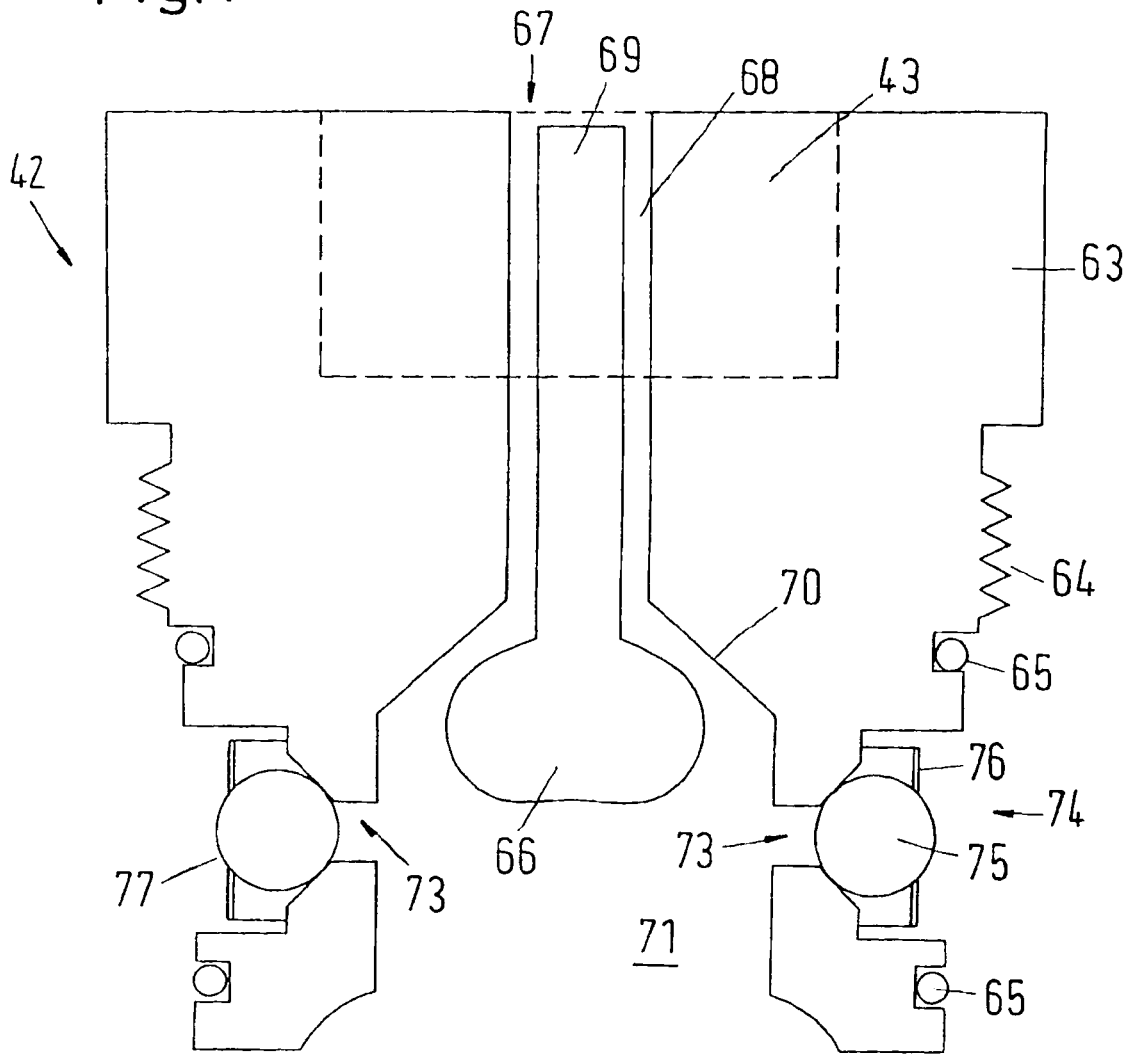
FIG. 4 is a schematic view of the combined inlet/outlet valve, used in the third example of FIG. 3.

The integral valve assembly 42, however, is designed differently from the integral valve assembly 17, used in FIG. 1. Further details of the integral valve assembly 42 can be seen in FIG. 4.

Similar to the integral valve assembly 16, used in FIG. 1, the fluid valve assembly 42 can be manufactured as a separate sub-assembly, to be inserted into the pump body 2 of a hydraulic pump 41 at a later time. The fluid valve assembly 42 comprises a valve block 63. The valve block 63 shows a thread 64 on part of its outside. Therefore, the fluid valve assembly 42 can be attached into an appropriate cavity 12 by a simple turning action.

O-rings 65 for sealing purposes are provided as well.

In a central portion of the valve block 63, a cylindrically shaped fluid inlet channel 68 is provided. Within the fluid inlet channel 68, the valve stem 69 of a fluid inlet valve 67 is mounted. The valve stem 69 connects a valve actuator 43 of the fluid inlet valve 67 to the valve poppet 66 of the fluid inlet valve 67. The valve actuator 43 is integrally formed within the valve block 63 of integrated valve assembly 42. In connection with the cone-shaped portion 70 of the fluid inlet channel 68, the valve poppet 66 can fluidly connect or shut off the fluid inlet channel 68 and the pre-chamber 71.

If the fluid valve assembly 42 is connected to the pump body 2 of the hydraulic pump 41, the pre-chamber 71 is connected through the top opening 10 of cylinder 4 to the working chamber 3 of cyclically changing volume.

The fluid outlet valve assembly 74 comprises a plurality of openings 73, which are arranged radially around the pre-chamber 71. Each opening 73 is provided with an associated ball 75. The balls 75 are pressed against the openings 73 by a force, which is exerted by an elastic, ring shaped band 76, arranged on the outside of the balls 75. To keep the balls 75 and the elastic band 76 in place, indentations or openings 77 are provided in the elastic band 76 at the positions of the balls 75. Of course, the fluid outlet valve assembly 74 can also be designed with a single opening 73.

If fluid inlet valve 67 is closed and the volume of the working chamber 3 decreases, the pressure of the liquid within the pre-chamber 71 increases. At some point, the balls 75 are lifted off their seats within the opening 73 against the force, exerted by the elastic band 76. Therefore, a fluid path is established and the fluid flows from the pre-chamber 71 through the fluid outlet valve assembly 74 to the outside.

The integral valve assembly 42 can, once again, be inserted into the single cavity 12 within the pump body 2 of hydraulic pump 41 through a single assembly access port 38. Because of the sealing rings 65 of integral valve assembly 42, no closing plate is necessary for the hydraulic pump 41. However, an appropriate connection has to be provided for supplying hydraulic fluid to fluid inlet channel 68 of fluid inlet valve 67.

Figure 5:
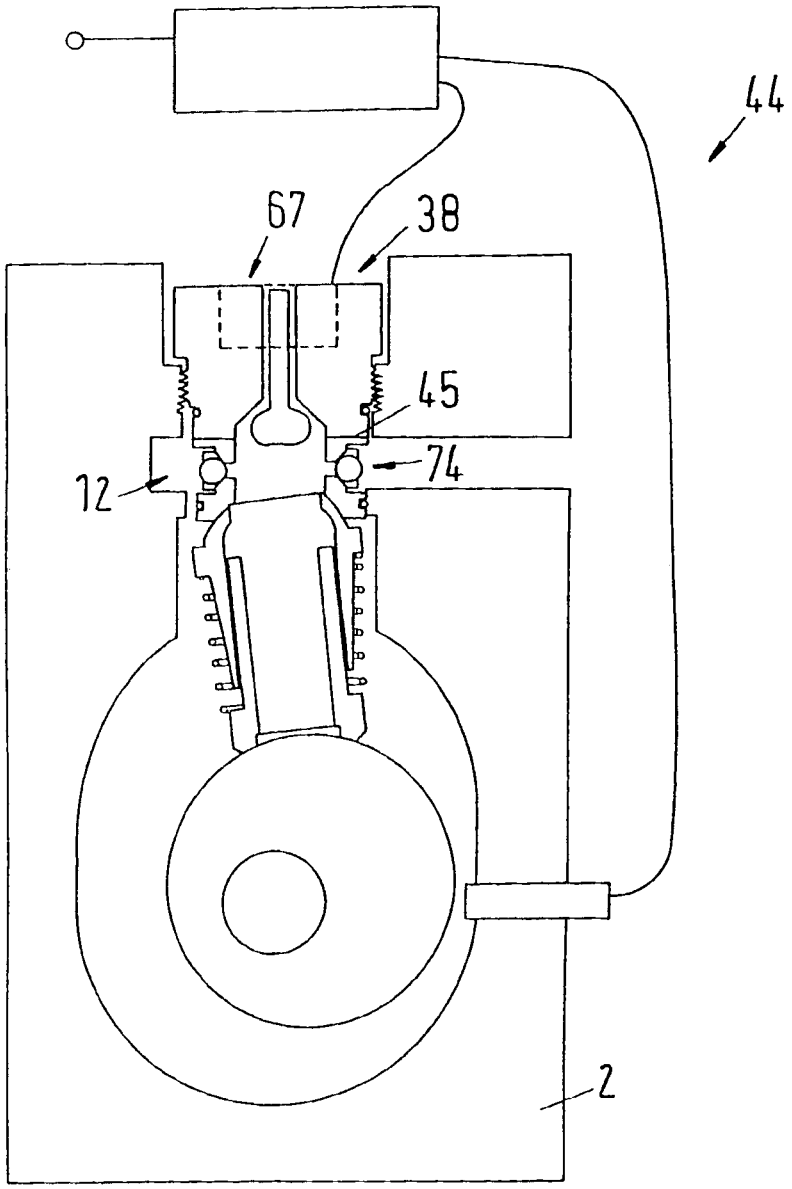
FIG. 5 is a schematic cross section of a fourth example of a hydraulic pump according to the invention.

In FIG. 5, yet another example of a hydraulic pump 44, according to the invention, is shown. The pump body 2 of hydraulic pump 44 showing FIG. 5 is identical to the pump body 2 of hydraulic pump 44, shown in FIG. 3. However, the integral valve assembly 42 is replaced by a valve unit, which comprises two distinct parts, namely a fluid inlet valve part 67 and a fluid outlet valve part 74.

Figure 6:
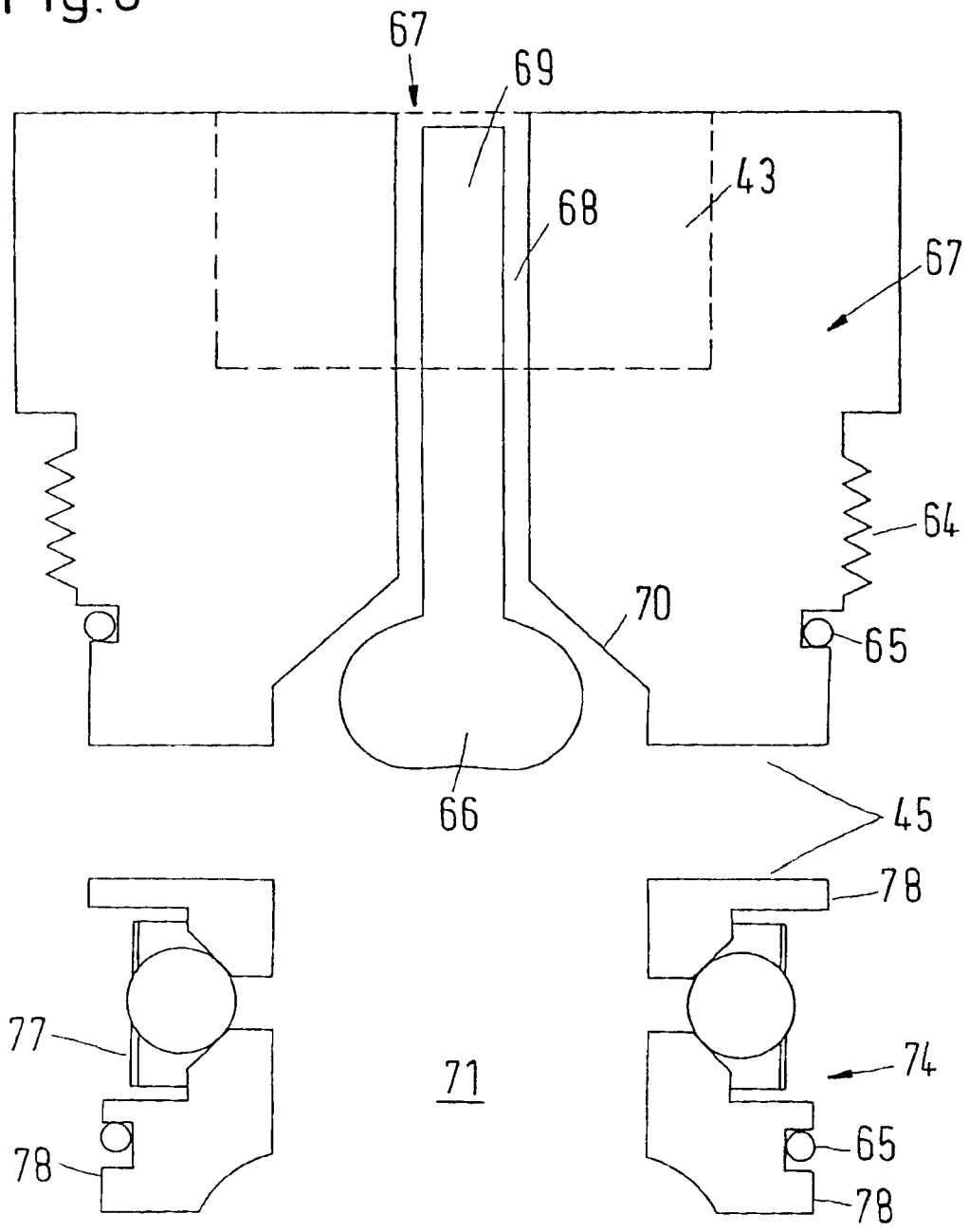
FIG. 6 is a schematic view of the combined inlet/outlet valve, used in the fourth example of FIG. 5.

The design of fluid inlet valve 67 and fluid outlet valve 74 is shown in FIG. 6 with more details. Please note, that the design of the two valves 67, 74 is very similar to the integral valve assembly 42 of FIG. 4. The only relevant difference is, that a cut 45 is provided, separating fluid inlet valve 67 and fluid outlet valve 74 from each other. Because integral valve assembly 42 of FIG. 4 and separated fluid inlet valve 67 and fluid outlet valve 74 of FIG. 6 are very similar to each other, the same reference numbers are used.

Inserting fluid inlet valve 67 and fluid outlet valve 74 into the common cavity 12 through single assembly access port 38 of hydraulic pump 44 is still very simple.

First, the fluid outlet valve 74 is inserted into single cavity 12. Please note, that fluid outlet valve 74 is held in place by its flange parts 78. No special fixation is necessary, because the fixation in the axial direction is performed by fluid inlet valve 67 via cut 45, where the two ringlike surfaces of fluid inlet valve 67 and fluid outlet valve 74 touch each other. Therefore, after inserting fluid outlet valve 74, fluid inlet valve 67 is inserted through single assembly acces port 38 and screwed in place by a turning action.

By separating fluid inlet valve 67 and fluid outlet valve 74, a plethora of combinations of different fluid inlet valves and fluid outlet valves can be provided with relatively little effort.

Figure 7:
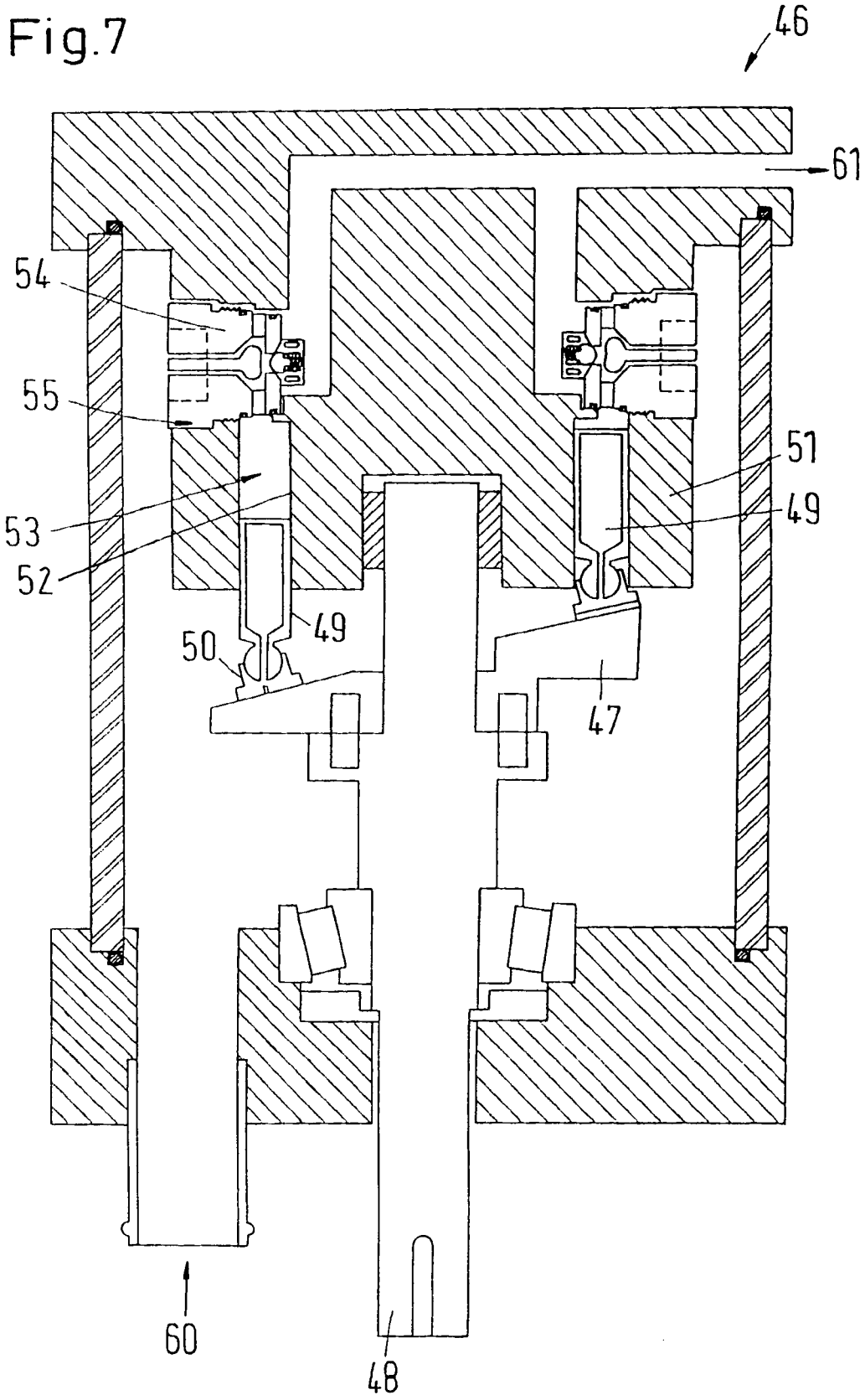
FIG. 7 is a schematic cross section of a fifth example of a hydraulic pump according to the invention.

In FIG. 7, yet another hydraulic pump 46, according to a fifth embodiment of the invention is shown.

The hydraulic pump 46 according to FIG. 7 is of the wobble-plate type 47. A rotatable shaft 48 turns a wobble plate 47. Several pistons 49 are attached to the wobble plate 47 by means of slippers 50. When the rotatable shaft 48 is turned, the pistons 49 reciprocate in and out of a respective corresponding cylindric space 52, provided in the pump body 51. Thus, a cyclically changing working chamber 53 is provided, which can be used for pumping.

On the side of the cylindrical space 52, which is opposed to the respective piston 49, a fluid valve assembly 54 is provided within a respective cavity 55, provided inside the pump body 51. Details of the fluid valve assembly 54 can be seen in FIG. 8.

Figure 8:
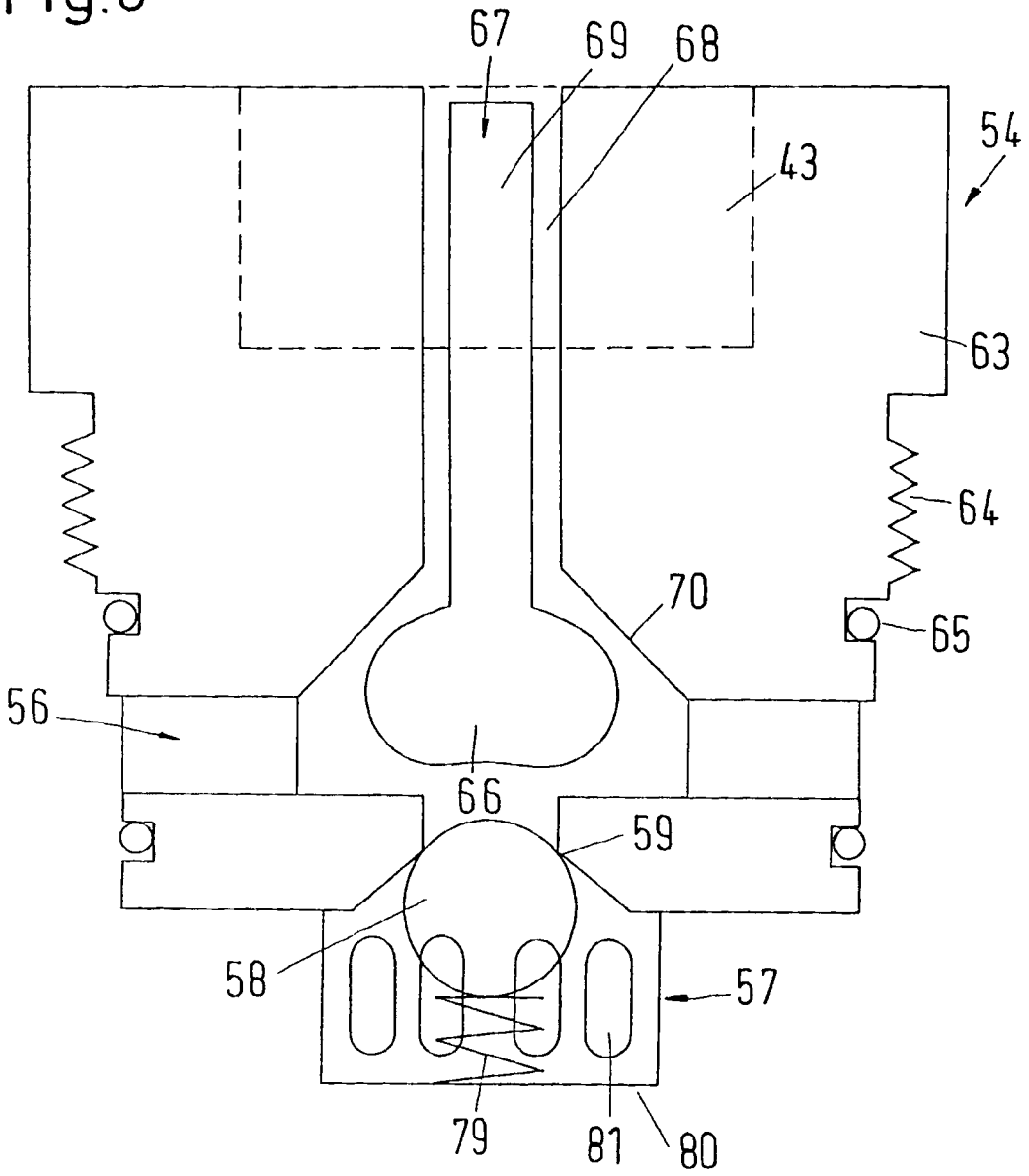
FIG. 8 is a schematic view of the combined inlet/outlet valve, used in the fifth example of FIG. 7.

Even the fluid valve assembly 54 in FIG. 8 shows some similarities to the fluid inlet assembly 42 in FIG. 2. Once again, for similar parts identical reference Nos. are chosen. The fluid inlet valve 67 of integral valve assembly 54 has a valve stem 69, actuated by the valve actuator 43. On one side of the valve stem 69, a valve poppet 66 is provided. In combination with the conical portion 70 of fluid inlet channel 68, the fluid inlet valve 67 can open or close the connection between fluid connection channel 56 and fluid inlet port 60 of hydraulic pump 46. A fluid inlet channel 68 is provided between the valve stem 69 and the valve block 63. The fluid connection channel 56 provides a fluid connection between the working chamber 53 and the fluid inlet valve 67 as well as between the working chamber 53 and the fluid outlet valve 57.

The fluid outlet valve 57 of valve assembly 54 is of the passive type.

Fluid outlet valve 57 is of a ball-poppet type, wherein the ball 58 is spring-loaded against its seat 59 by a spring 79. The ball 58 and the spring 79 are enclosed in a casing 80, showing several slits 81, so that the hydraulic fluid can leave the casing 80.

In their open position the fluid inlet valves 67 connect the fluid inlet port 60 with a fluid connection channel 56, formed within the fluid valve assembly 54 inside the pump body 51. Fluid outlet valves 57 connect in their open position the fluid connection channel 56 to the fluid outlet channel 61. The fluid connecting channel 56 connects the fluid inlet valve 67 and the fluid outlet valve 57 with the cyclically changing working chamber 3. By appropriately controlling the opening and closing of the fluid inlet valves 67, a full stroke pumping mode, a partial stroke pumping mode and a non-pumping mode can be realised.

Figure 9:
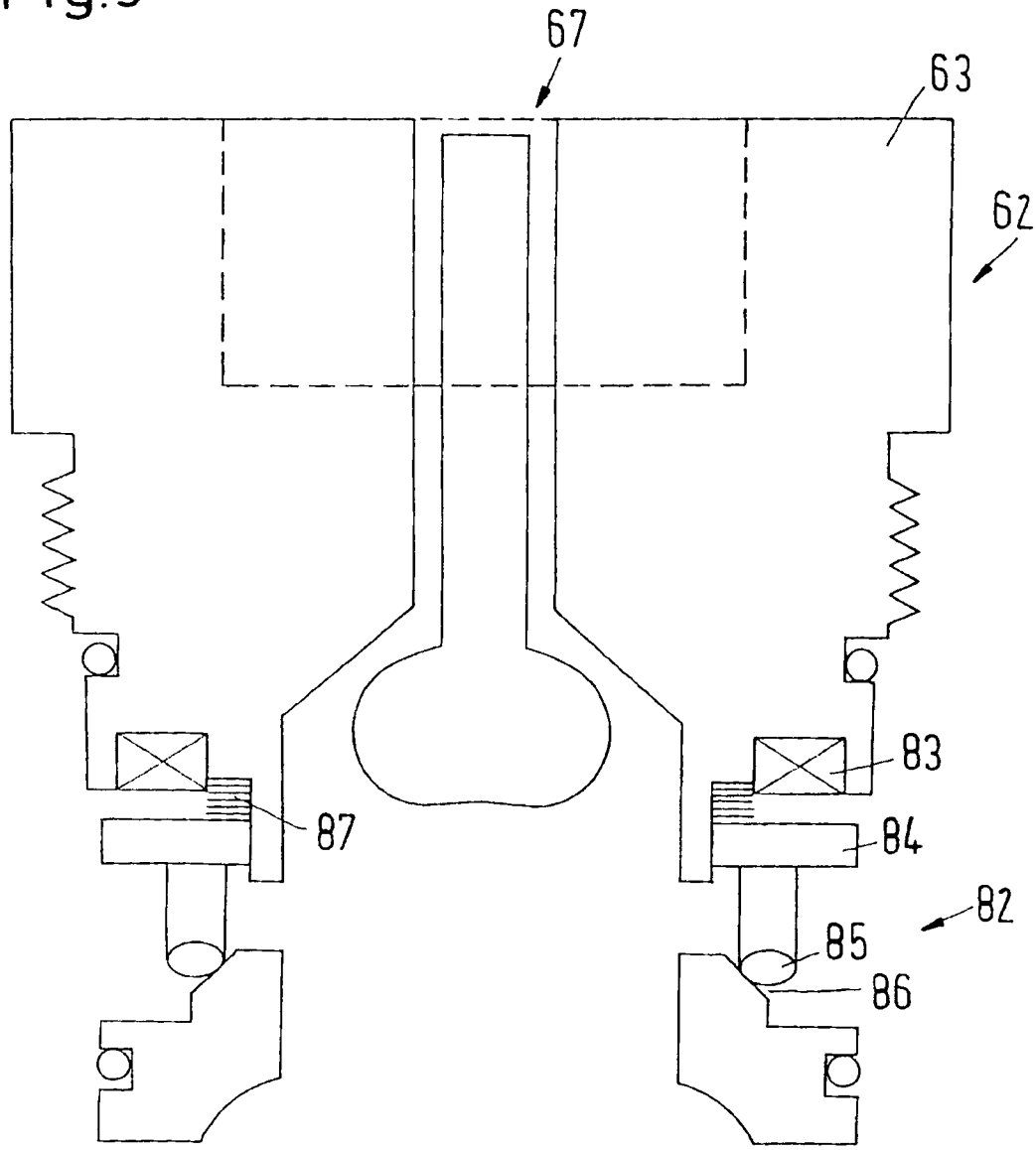
FIG. 9 is a schematic cross section of a first embodiment of a valve assembly comprising electrically actuated inlet and outlet valves.

FIG. 9 shows yet another integral valve assembly 62. The fluid inlet valve 67 as part of integral valve assembly 62 is similar to that of integral valve assembly 42 in FIGS. 4 and 54 in FIG. 8. The details can be deferred from there.

Different from the other integral valve assemblies 42, 54, present integral valve assembly 62 shows a fluid outlet valve 82 that is electrically actuated. For this, a coil 83 is provided in the valve block 63. When activated, the magnetic field, provided by coil 83, pulls the moving pole 84 towards the coil 83. Therefore, the sealing ring 85 is lifted off its seat 86. This way, a fluid outlet channel will be opened, so that hydraulic fluid can pass through the fluid outlet valve 82. If the magnetic coil 83 is switched off again, the force of a spring 87 prevails and pushes the moving pole 84 away from the coil 83. Therefore, sealing ring 85 is pressed against seat 86 and the fluid outlet valve 82 is closed.

Figure 10:
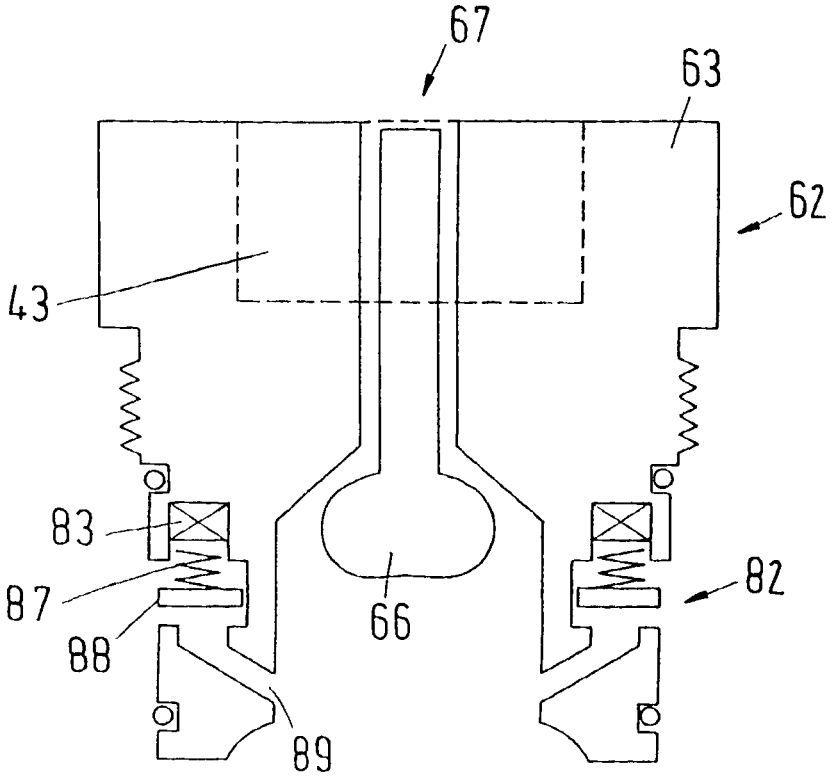
FIG. 10 is a schematic cross section of a second embodiment of a valve assembly comprising electrically actuated inlet and outlet valves.

FIG. 10 shows another possible integral valve assembly 62, comprising an electrically actuated fluid inlet valve 67, as well as an electrically actuated fluid outlet valve 82. Compared to the valve assembly 62, shown in FIG. 9, the fluid outlet valve 82 is modified.

Here, the fluid outlet channels 89 are closed by flat, disc shaped closing members 88. The closing members 88 are actuated by the magnetic field, provided by a coil 83 and the counteracting force of a spring 87, in a way similar to the fluid outlet valve 82 of FIG. 9. However, due to the disc like shape of the closing members 88, higher pressure differences can be handled by the fluid outlet valve 82.

Of course, it is possible, that a plurality of individual fluid outlet channels 89 are provided. Here, for every individual fluid outlet channel 89, a separate disc shaped or plate shaped closing member 88 can be provided. However, it is also possible to use a single, ring shaped closing member 88 for all fluid outlet channels 89. Also, it is possible to provide an essentially continuos fluid outlet channel 89. Of course, a mechanical support has to be provided.

Figure 12:
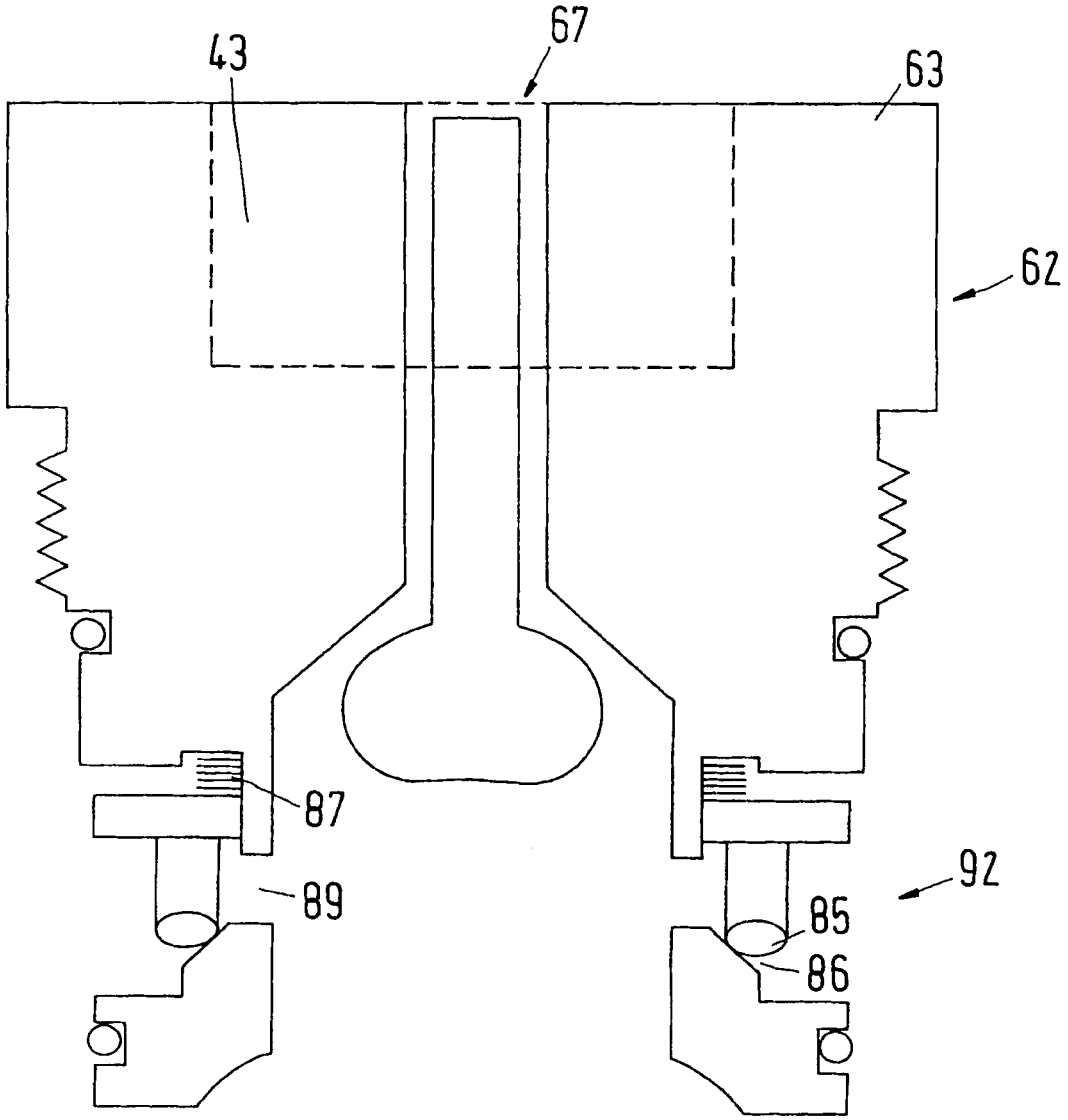
FIG. 12 is a schematic view of a variation of the valve, shown in FIG. 9.
Figure 13:
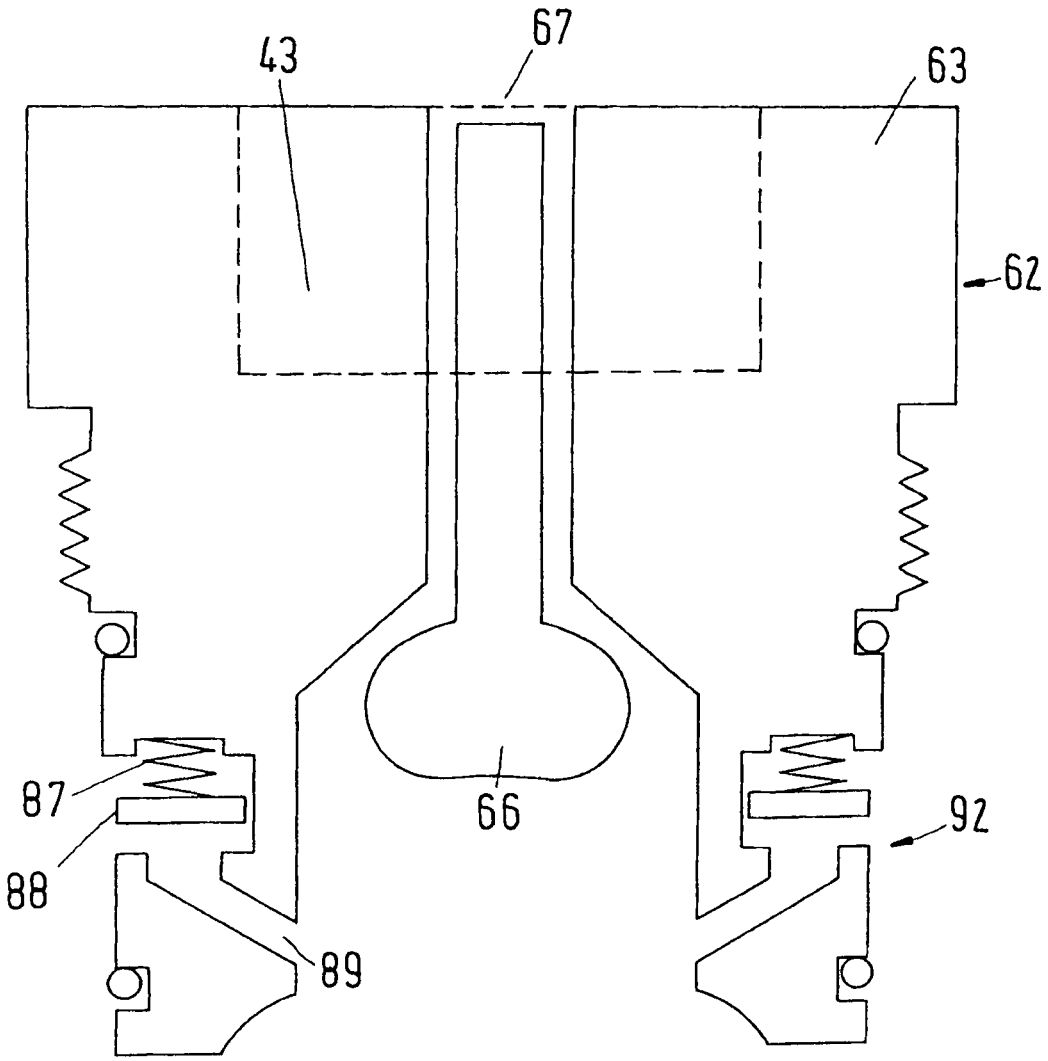
FIG. 13 is a schematic view of a variation of the valve, shown in FIG. 10.

The construction of the valve assemblies 62, shown in FIGS. 9 and 10, can also be used for a passive fluid outlet valve 82 version of said valve assembly 62. Such valve assemblies 62 are shown in FIGS. 12 and 13, wherein integral valve assembly of FIG. 12 corresponds to integral valve assembly of FIG. 9 and integral valve assembly of FIG. 13 corresponds to integral valve assembly of FIG. 10. As can be seen from FIGS. 12 and 13, the essential modification is that the coil 83 is omitted. If necessary, the size of the respective parts of the passive fluid outlet valve can be resized. Also, the strength of the spring 87 (i.e. the spring constant) can be adjusted, if necessary.

Figure 11:
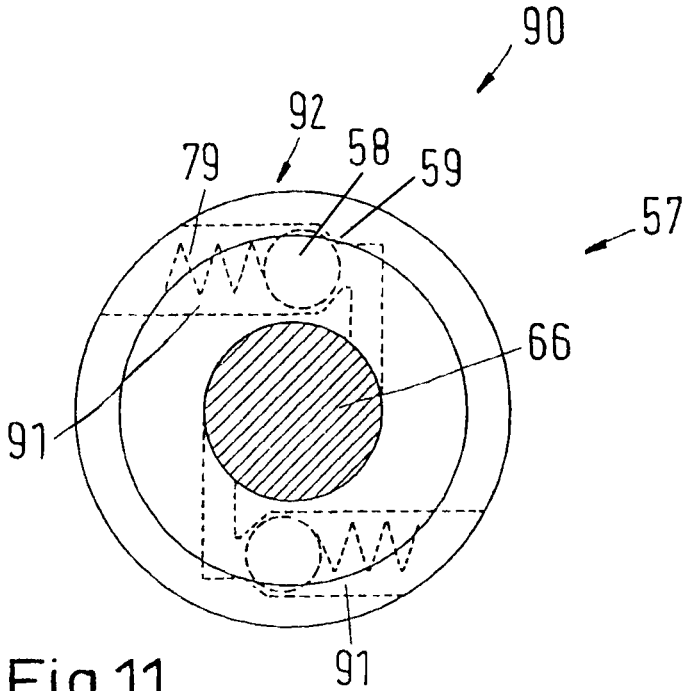
FIG. 11 is a schematic, partially broken bottom view of another embodiment of a combined inlet/outlet valve.

In FIG. 11, another possible design for the outlet valve part 57 of a valve assembly 90 is shown. FIG. 11 is a schematical view from the bottom. In the middle, the valve's poppet head 66 of the fluid inlet valve 67 is visible.

The fluid outlet valve part 92 of the fluid valve assembly 90 is of a passive type. For this, two spring loaded 79 balls 58 are provided. The balls 58 are pressed into their respective seats 59 by the force of the spring 79. Because the individual valve assemblies 92, comprising a ball 58 and a spring 79, respectively, are located in channels 91, which are arranged in a centrifugal direction (with respect to the radial symmetry of the fluid valve assembly 90), the springs 79 can be designed to be longer. Therefore, the mechanical stress on the springs 79, when the individual valve assembly 92 is opened, can be reduced.

Of course, it is also possible to use one, two, three, four, five, six or even more channels 91 with individual valve assemblies 92.

While the present invention has been illustrated and described with respect to a particular embodiment thereof, it should be appreciated by those of ordinary skill in the art that various modifications to this invention may be made without departing from the spirit and scope of the present.

What is claimed is:

1. A fluid working machine, comprising:

at least one working chamber with a cyclically changing volume;

a common pre-chamber fluidly connected to said working chamber;

at least one fluid inlet port with a fluid inlet valve; and at least one fluid outlet port with a fluid outlet valve;

an electronic controlling unit controlling the opening and closing movement of said fluid inlet valve and/or said fluid outlet valve such that said fluid working machine alternates between a pumping mode and a motoring mode;

wherein said fluid inlet valve and said fluid outlet valve are arranged around said common pre-chamber;

wherein at least a portion of said common pre-chamber is disposed between said working chamber and said fluid inlet valve; and wherein said fluid inlet valve and said fluid outlet valve are configured to be installed through a common access port in the fluid working machine.

2. The fluid working machine according to claim 1, wherein said fluid inlet valve has a larger cross section than said fluid outlet valve.

3. The fluid working machine, according to claim 1, wherein said fluid inlet valve and said fluid outlet valve are arranged as separate units.

4. The fluid working machine according to claim 1, wherein said fluid inlet valve and said fluid outlet valve are arranged in an integral valve assembly, the integral valve assembly being configured to be installed through the common access port connected to said common pre-chamber.

5. The fluid working machine according to claim 4, wherein said integral valve assembly comprises a sealing means for sealingly closing the common assembly access port.

6. The fluid working machine according to claim 1, wherein said working chamber comprises a reciprocating piston in a cylinder.

7. The fluid working machine according to claim 1, wherein the fluid working machine comprises a plurality of working chambers, and a plurality of said fluid inlet ports and/or said fluid outlet ports, wherein the plurality of said fluid inlet ports connect to a common fluid inlet manifold and/or the plurality of said fluid outlet ports connect to a common fluid outlet manifold.

8. The fluid working machine according to claim 1, wherein at least a part of said fluid inlet valve and/or fluid outlet valve are/is actively controllable.

9. The fluid working machine according to claim 1, wherein said at least one outlet valve comprises a plurality of circumferentially arranged openings and/or an essentially circumferential opening, and at least one corresponding closing means, associated to said opening(s), wherein a closing force of the closing means is exerted by an elastic member.

10. The fluid working machine according to claim 1, wherein the outlet valve comprises a plurality of circumferentially arranged openings and/or an essentially circumferential opening, and at least one closing means, corresponding to said opening(s) wherein said closing means comprises at least one actuator.

11. A valve assembly comprising:

at least one fluid inlet port with a fluid inlet valve; and at least one fluid outlet port with a fluid outlet valve;

wherein a common pre-chamber fluidly connects said valve assembly to a working chamber with a cyclically changing volume;

wherein said fluid inlet valve and said fluid outlet valve are arranged around said common pre-chamber;

wherein at least a portion of said common pre-chamber is disposed between said working chamber and said fluid inlet valve;

wherein the fluid inlet valve and the fluid outlet valve are configured to be installed through a common access port in the fluid working machine; and wherein the inlet valve and the outlet valve are actively controllable to open and close.

12. A fluid working machine, comprising:

at least one working chamber with a cyclically changing volume;

at least one fluid inlet port with a fluid inlet valve that moves between an open and a closed position; and at least one fluid outlet port with a fluid outlet valve that moves between an open and a closed position;

wherein said fluid inlet valve and said fluid outlet valve are provided in an integral valve assembly, the integral valve assembly being configured to be assembled through a common assembly access port; and an electronic controlling unit configured to actively control the opening and closing movement of said fluid inlet valve and/or said fluid outlet valve such that said fluid working machine alternates between a pumping mode and a motoring mode.

13. A fluid working machine, comprising:

at least one working chamber with a cyclically changing volume;

at least one fluid inlet port with a fluid inlet valve;

at least one fluid outlet port with a fluid outlet valve;

wherein said fluid inlet valve and said fluid outlet valve are provided in an integral valve assembly, the integral valve assembly being configured to be assembled through a common assembly access port; and an electronic controlling unit configured to actively control the opening and closing movement of said fluid inlet valve and/or said fluid outlet valve such that said fluid working machine can alternate between a full stroke pumping mode, a partial stroke pumping mode, a non-pumping mode and a motoring mode.

* * * * *